US008020488B1

(12) United States Patent
Liu et al.

(10) Patent No.: US 8,020,488 B1
(45) Date of Patent: Sep. 20, 2011

(54) STRAPPING MACHINE

(75) Inventors: Chin-Chang Liu, Taichung (TW); Chi-Jan Su, Taipei (TW)

(73) Assignees: Tekpak Corporation, Taichung (TW); Transpak Equipment Corporation, Taipei (TW)

( * ) Notice: Subject to any disclaimer, the term of this patent is extended or adjusted under 35 U.S.C. 154(b) by 0 days.

(21) Appl. No.: 12/719,110

(22) Filed: Mar. 8, 2010

(51) Int. Cl.
*B65B 13/04* (2006.01)

(52) U.S. Cl. ..... 100/26; 53/589

(58) Field of Classification Search ..... 100/7, 25, 100/26, 34; 53/589
See application file for complete search history.

(56) References Cited

U.S. PATENT DOCUMENTS 3,939,762 A * 2/1976 Smitherman et al. ..... 100/4
5,379,687 A * 1/1995 Moseley ..... 100/3

* cited by examiner

*Primary Examiner* — Jimmy T Nguyen
(74) *Attorney, Agent, or Firm* — Ming Chow; Sinorica, LLC

(57) ABSTRACT

A strapping machine includes a machine body, a strap chute, a strap supplying device, and a controlling device. The machine body has a working surface. The strap chute includes an access guiding portion and an exit guiding portion. The controlling device can control the access guiding portion and the exit guiding portion moving to suitable heights independently. So, an object to can be moved in for a strapping work and then be moved out. Hence, the vertical moving distances of the access guiding portion and the exit guiding portion can be adjusted independently. In addition, it can save the waiting time.

2 Claims, 10 Drawing Sheets

STRAPPING MACHINE

BACKGROUND OF THE INVENTION

1. Field of the Invention

The present invention relates to a strapping machine. Particularly, it relates to a strapping machine having an access guiding portion and an exit guiding portion that can be moved independently. The vertical moving distances of the access guiding portion and the exit guiding portion can be adjusted independently. In addition, it can save the waiting time.

2. Description of the Prior Art

Referring to FIG. 1, it shows the process of a conventional cross-strapping work. First, the object 70 (to be strapped) is moved by a conveyor system 93 to a conventional first strapping machine 91 (from a first position P1 to a second position P2). Then, it performs a first strapping work (or called lateral strapping). After which, this object 70 is moved to a third position P3. At this moment, the angle θ between the strap 100 on the object 70 and the moving direction is 90 degrees. A worker 71 has to rotate the object 70 ninety degrees horizontally so that the strap 100 on the object 70 and the moving direction can be aligned. Furthermore, this object 70 is moved to a conventional second strapping machine 92 (at a four position P4) so as to carry out a second strapping work (or call longitudinal strapping). After which, the object 70 is moved out by the conveyor system 93 (at a fifth position P5). Finally, there are two straps 100 (shaped as a cross) on this object 70. Thus, the cross-strapping work can be done.

Another traditional longitudinal strapping machine 80 is shown in FIGS. 2 and 3. It includes a machine base 81, a strap supplying assembly 82, a strap guider 83 (or called strap chute), and a driving portion 84. The strap guider 83 includes a vertical guide-in portion 831, a horizontal guiding portion 832, and a vertical guide-out portion 833. Also, a guiding channel 834 is formed in this strap guider 83 so that a strap 100 can pass through. The horizontal guiding portion 832 is fixed on the machine base 81 (but the fixed mechanism or structure is not shown in FIGS. 2 and 3). This horizontal guiding portion 832 has a guide-in hole 832A facing downward and a guide-out hole 932B facing downward. The function of the driving portion 84 is to move out the vertical guide-in portion 831 and the vertical guide-out portion 833 so that the object 70 can pass through without collision.

However, the traditional longitudinal strapping machine 80 still contains the following problems and disadvantages.

[1] It cannot make any adjustment depending on the height of the object. As illustrated in FIGS. 4 and 5, the vertical guide-in portion 831 and the vertical guide-out portion 833 can be rotated out horizontally (see FIG. 4; type one) or be moved away to one side (see FIG. 5; type two). But, it cannot make any adjustment depending on the height of the object. No flexible adjustment is allowed.

[2] The wider object is possible to hit the strap guider. As shown in FIGS. 4 and 5, if the width of the object 70 is equal to a first width W1, when this object 70 is moved to the traditional longitudinal strapping machine 80, there is no collision problem. But, if the width of the object 70 is equal to a second width W2, when this object 70 is moved to the traditional longitudinal strapping machine 80, the object 70 will hit the vertical guide-in portion 831.

[3] It cannot differentiate the height of the object and the moving distance is not adjustable. As depicted in FIG. 6 (type three of traditional strapping machine 80), the distance between the horizontal guiding portion 832 of the traditional strapping machine 80 and the working surface 811 is defined as a vertical distance S. If the height of three objects 70 are a first height H1, a second height H2, and a third height H3 respectively, the vertical guide-in portion 831 and the vertical guide-out portion 833 must move longer than (or at least equal to) the vertical distance S. Under such circumstances, no matter the object 70 is thick or thin, all the moving distances are the same (the vertical distance S). Therefore, the required time for one cycle of the strapping work is long. The entire working efficiency cannot be raised.

SUMMARY OF THE INVENTION

The object of the present invention is to provide a strapping machine. In which, the vertical moving distances of the access guiding portion and the exit guiding portion can be adjusted independently. Plus, it can save the waiting time. Therefore, this invention can solve the problems listed as follows: it cannot make any adjustment depending on the height of the object; the wider object is possible to hit the strap guider; and it cannot differentiate the height of the object and the moving distance is not adjustable.

In order to achieve the above mentioned object, this invention is provided. A strapping machine comprising:

a machine body having a working surface, a first hole, and a second hole;

a strap chute including an access guiding portion and an exit guiding portion; the access guiding portion has an access hole which is corresponding to the first hole; the exit guiding portion has an exit hole which is corresponding to the second hole;

a strap supplying device for supplying a strap and for performing a strapping work; the strap being supplied into the strap chute via the first hole and the access hole and then being guided out via the exit hole and the second hole, the strap being back to the strap supplying device for performing a strapping movement; and a controlling device having a controller, a first driving portion, and a second driving portion; the first driving portion being provided for moving the access guiding portion vertically, the second driving portion being provided for moving the exit guiding portion vertically; a vertically moving distance of the access guiding portion and another moving distance of the exit guiding portion being adjustable independently.

DETAILED DESCRIPTION OF THE PREFERRED EMBODIMENT

Figure 1:
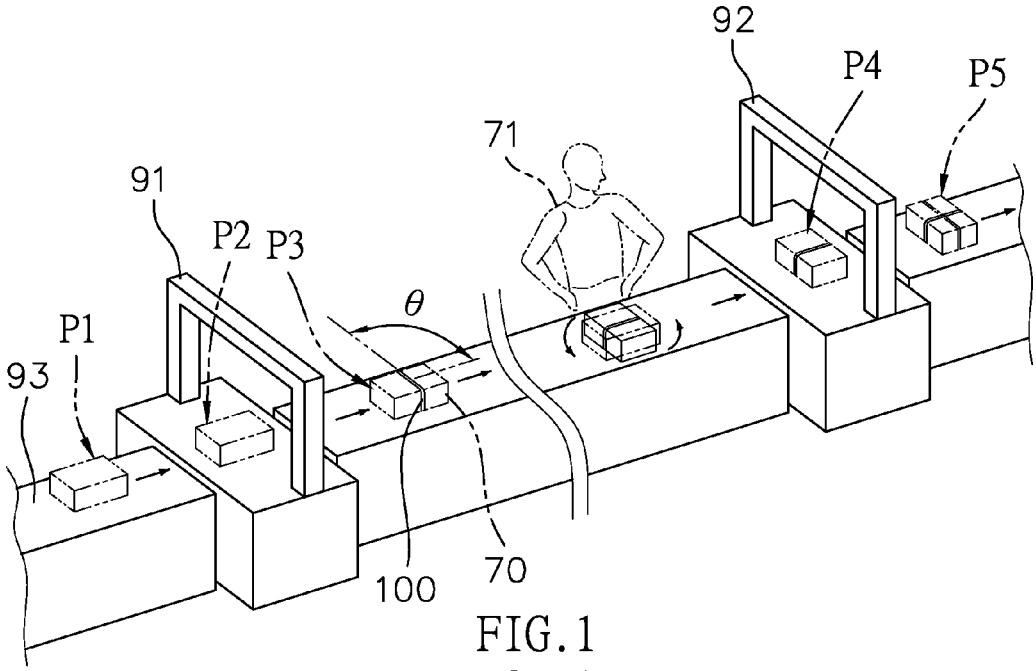
FIG.1 (PRIOR ART)
FIG. 1 is a perspective view showing the process of a conventional cross-strapping work.
Figure 2:
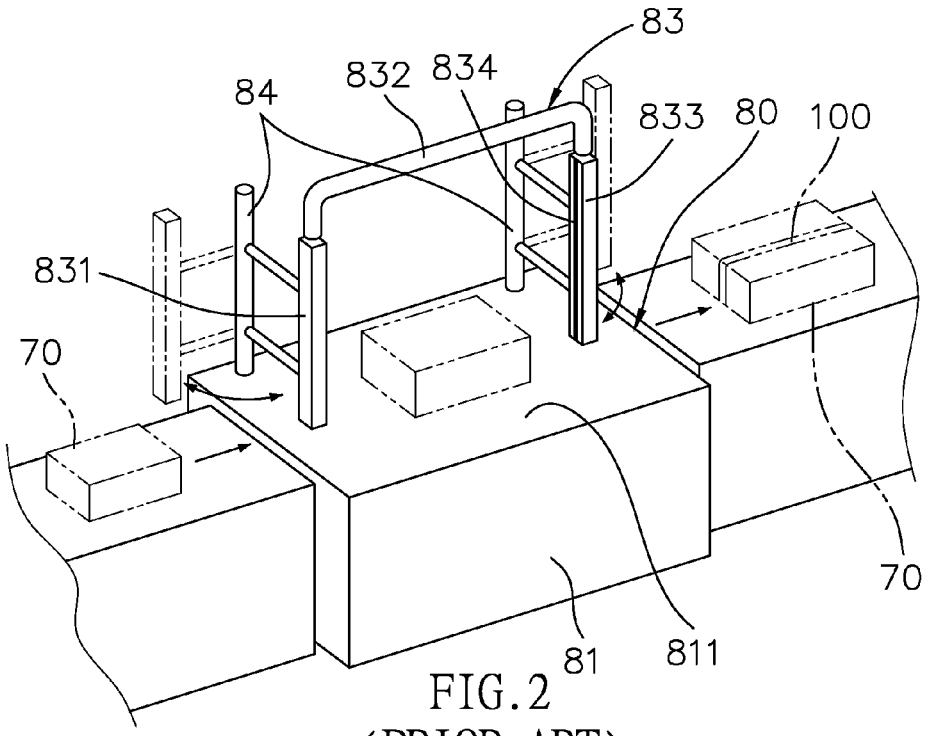
FIG.2 (PRIOR ART)
FIG. 2 is a perspective view of a traditional longitudinal strapping machine.
Figure 3:
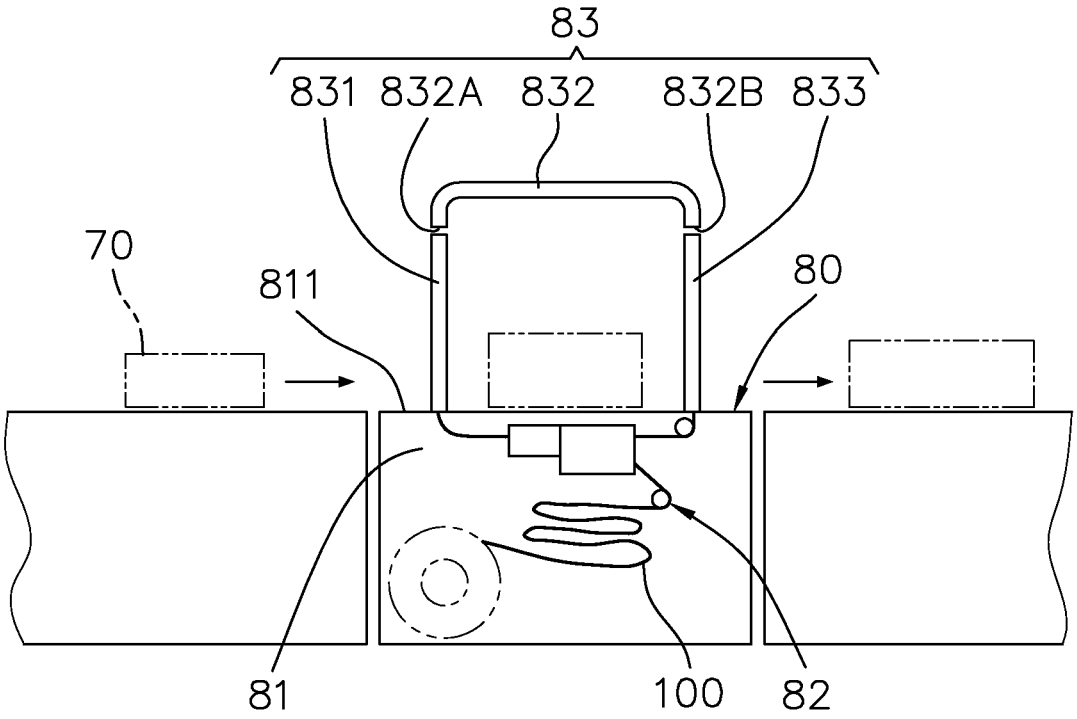
FIG.3 (PRIOR ART)
FIG. 3 illustrates a traditional longitudinal strapping machine.
Figure 4:
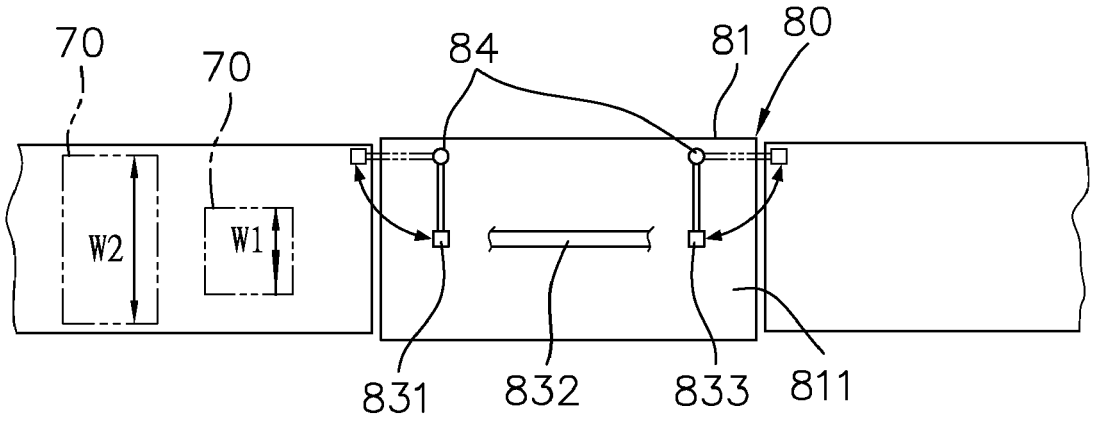
FIG.4 (PRIOR ART)
FIG. 4 is a top view showing the operating type one of the traditional longitudinal strapping machine.
Figure 5:
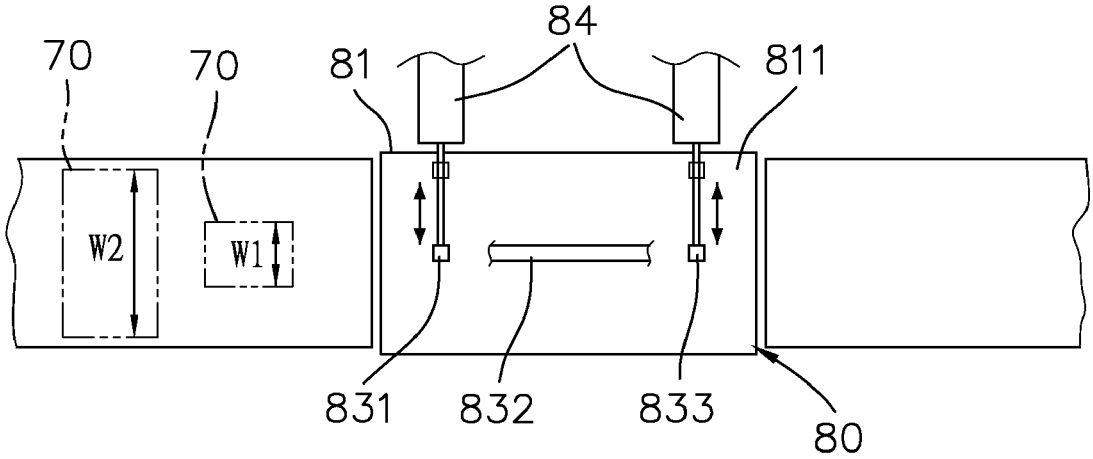
FIG.5 (PRIOR ART)
FIG. 5 is a top view showing the operating type two of the traditional longitudinal strapping machine.
Figure 6:
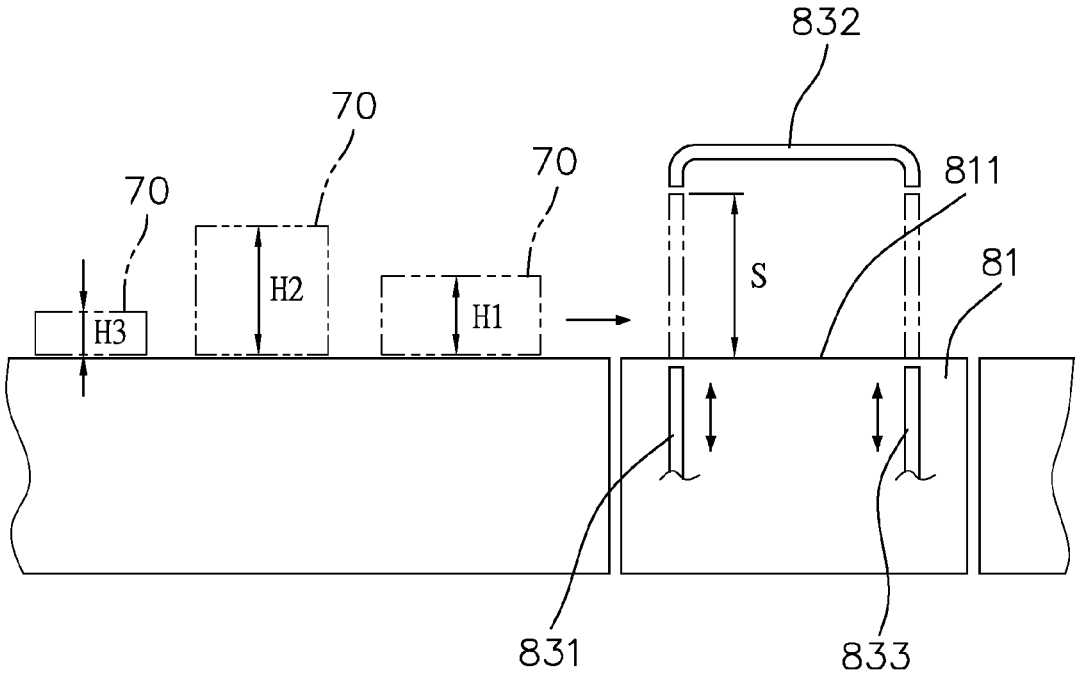
FIG.6 (PRIOR ART)
FIG. 6 shows the operating type three of the traditional longitudinal strapping machine.
Figure 7:
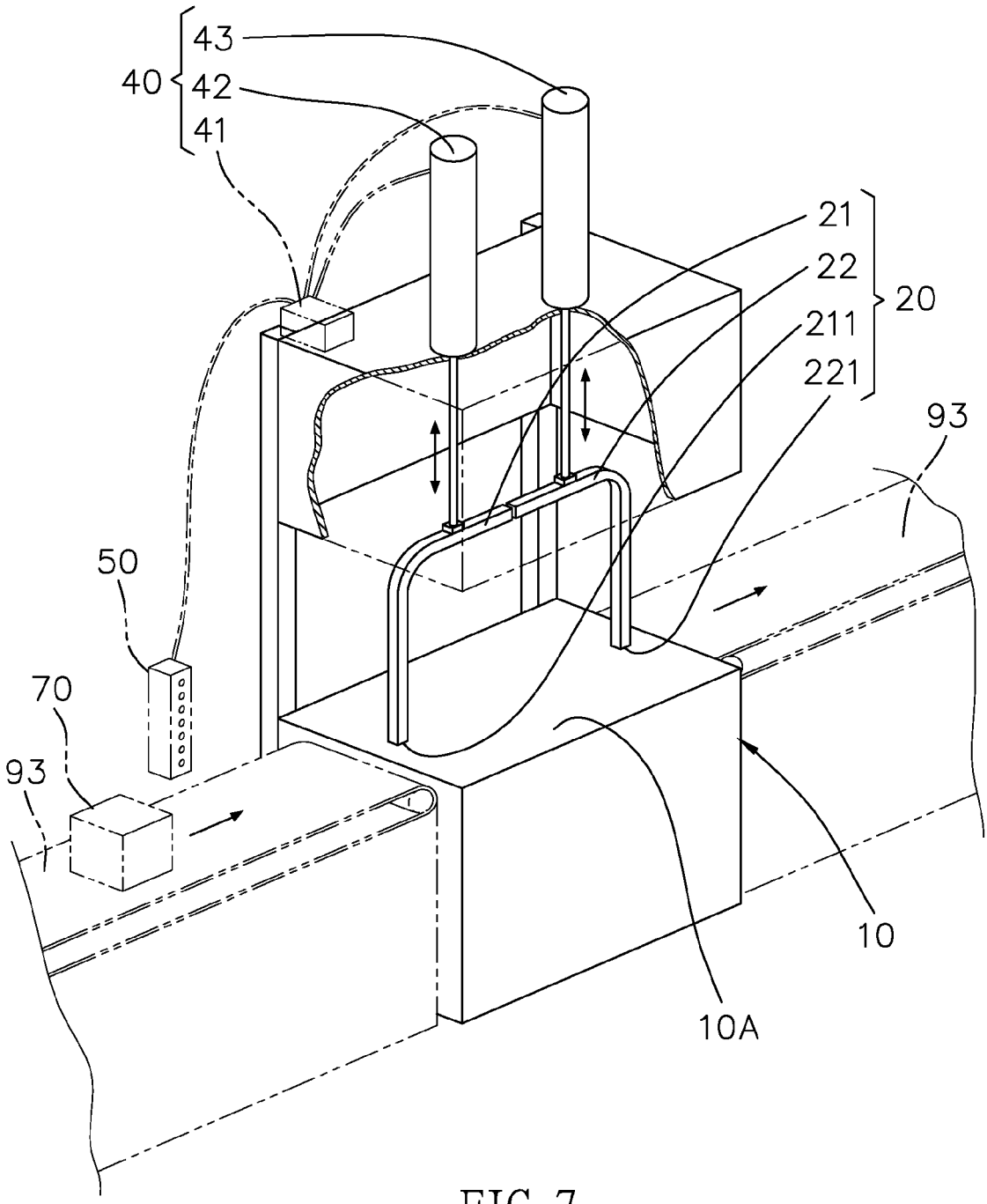
FIG. 7 is a perspective view of the present invention.
Figure 8:
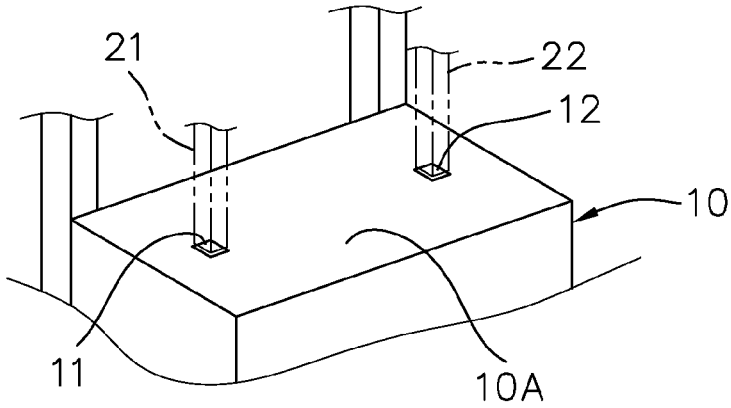
FIG. 8 is a view showing a portion of the present invention.
Figure 9:
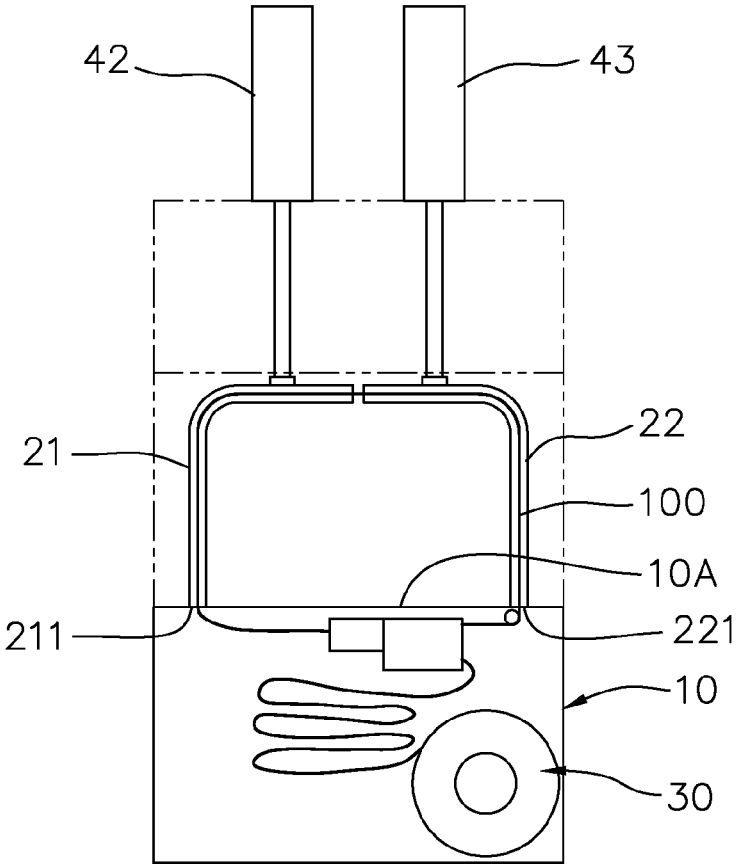
FIG. 9 is another view the present invention.

Referring to FIGS. 7, 8 and 9, the present invention is a strapping machine. It comprises a machine body 10, a strap chute 20, a strap supplying device 30, and a controlling device 40.

With regard to the machine body 10, it has a working surface 10A, a first hole 11, and a second hole 12.

The strap chute 20 includes an access guiding portion 21 and an exit guiding portion 22. The access guiding portion 21 has an access hole 211 which is corresponding to the first hole 11. The exit guiding portion 22 has an exit hole 221 which is corresponding to the second hole 12.

Concerning the strap supplying device 30, it can supply a strap 100 and can perform a strapping work. The strap 100 is supplied into the strap chute 20 via the first hole 11 and the access hole 211 and then is guided out via the exit hole 221 and the second hole 12. After which, the strap 100 is back to the strap supplying device 30 for performing a strapping movement. The strap supplying device 30 at least includes a strap feeding device, a strap retreat device, strap pulling device, a strap heating device, and a strap cutting device (all of them are not shown and not described here because they are commonly used and known in this field).

About the controlling device 40, it has a controller 41, a first driving portion 42, and a second driving portion 43. The first driving portion 42 is provided for moving the access guiding portion 21 vertically. Similarly, the second driving portion 22 is provided for moving the exit guiding portion 22 vertically. A vertically moving distance of the access guiding portion 21 and another moving distance of the exit guiding portion 22 are adjustable independently.

As illustrated in FIG. 7, the strapping machine in this invention can be combined with a conveyor system 93. The conveyor system 93 can move an object 70 to be strapped to the working surface 10A. The vertically moving distance of the access guiding portion 21 and another moving distance of the exit guiding portion 22 can be controlled at a height just slight above the object 70 (which means the minimum moving distance). Hence, it can save the strapping time. The controller 41 can control the first driving portion 42 and the second driving portion 43 so as to control the required movements of the access guiding portion 21 and of the exit guiding portion 22. This controller 41 can be set or adjusted by an operator manually.

Of course, this invention can further include an object height detector 50 for detecting the height of the object 70. Hence, the controller 41 can control the vertical moving distances of the access guiding portion 21 and of the exit guiding portion 22. So, they can be just slightly higher than the object 70 to be strapped.

Figure 10A:
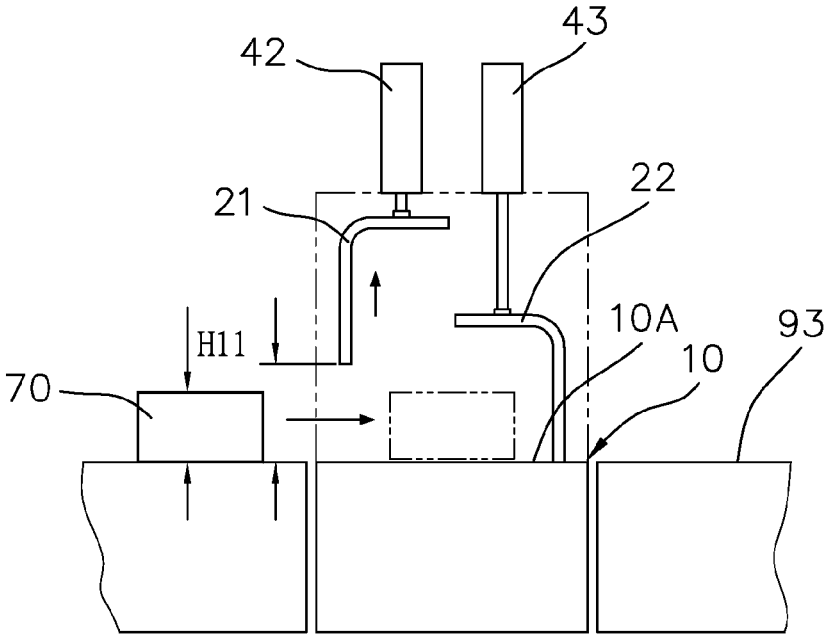
FIG. 10A illustrates the strapping process one of the present invention.
Figure 10B:
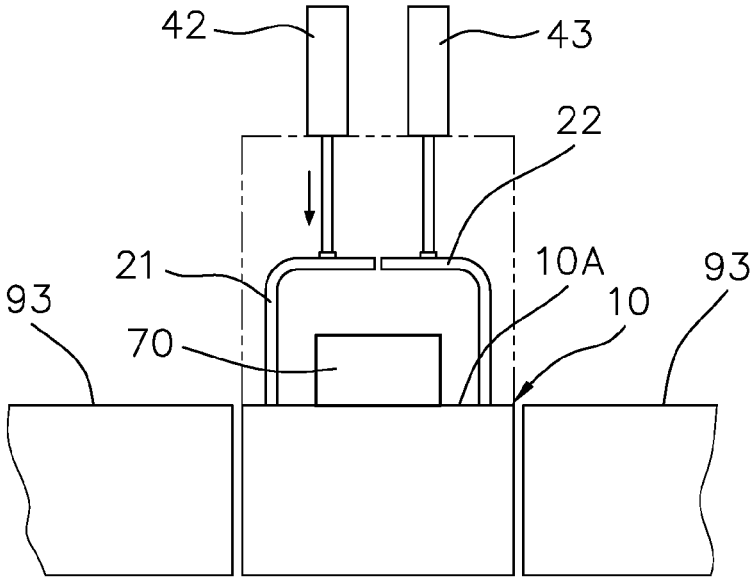
FIG. 10B illustrates the strapping process two of the present invention.
Figure 10C:
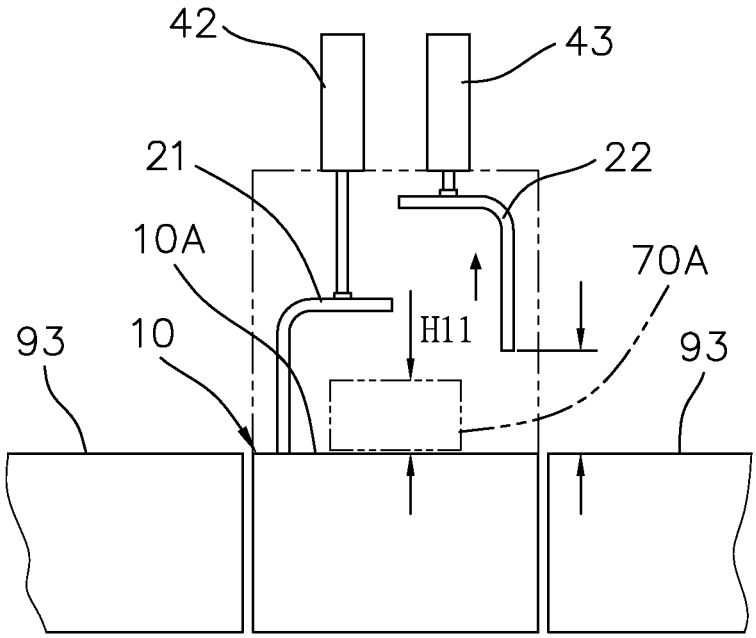
FIG. 10C illustrates the strapping process three of the present invention.
Figure 10D:
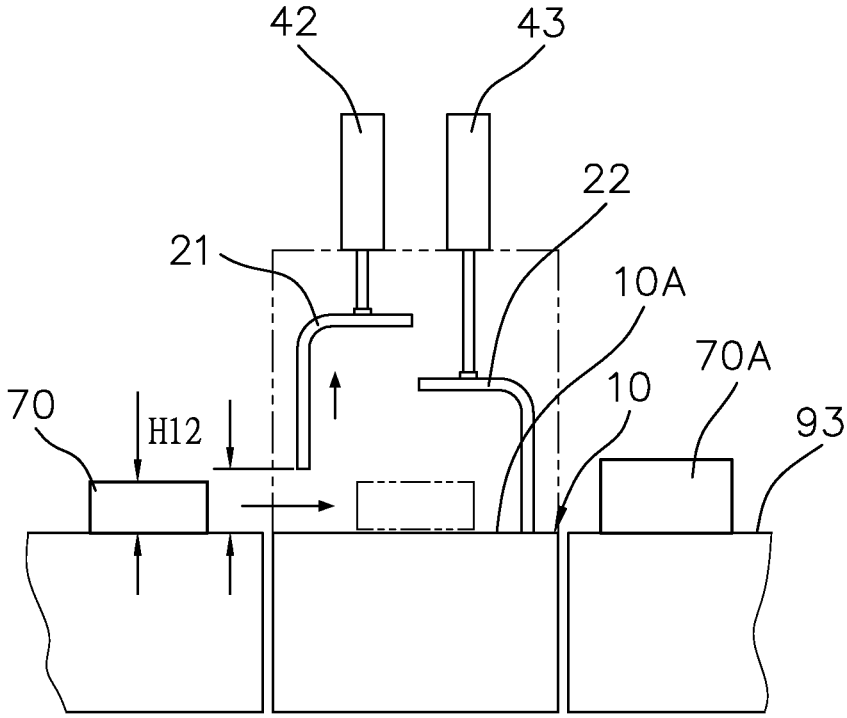
FIG. 10D illustrates the strapping process four of the present invention.

Referring to FIG. 10A, when an object 70 with a first predetermined height H11 is moved by the conveyor system 93, the first driving portion 42 drives the access guiding portion 21 upward and becomes slightly higher than the first predetermined height H11. Under this condition, the space is enough to allow the object 70 moving into the working surface 10A. As exhibited in FIG. 10B, after the object 70 is placed on the working surface 10A, the first driving portion 42 forces the access guiding portion 21 moving down to its original position. At this moment, the access hole 211 is corresponding to the first hole 11 (see FIG. 8). Then, it can perform a strapping work. As shown in FIG. 10C, after the strapping work is done (the object 70 becomes a strapped object 70A), the second driving portion 43 drives the exit guiding portion 22 upward and becomes slightly higher than the first predetermined height H11. The strapped object 70A can be moved out. As shown in FIG. 10D, after the strapped object 70A (having the first predetermined height H11) is moved out, the second driving portion 43 forces the exit guiding portion 22 moving down to its original position. Meanwhile, there is another object 70 having a second predetermined height H12 on the conveyor system 93. It is ready to enter the working surface 10A for the next strapping work cycle. At this time, the first driving portion 42 drives the access guiding portion 21 upward and slightly higher than the second predetermined height H12 for allowing the object 70 entering the working surface 10A.

Figure 11:
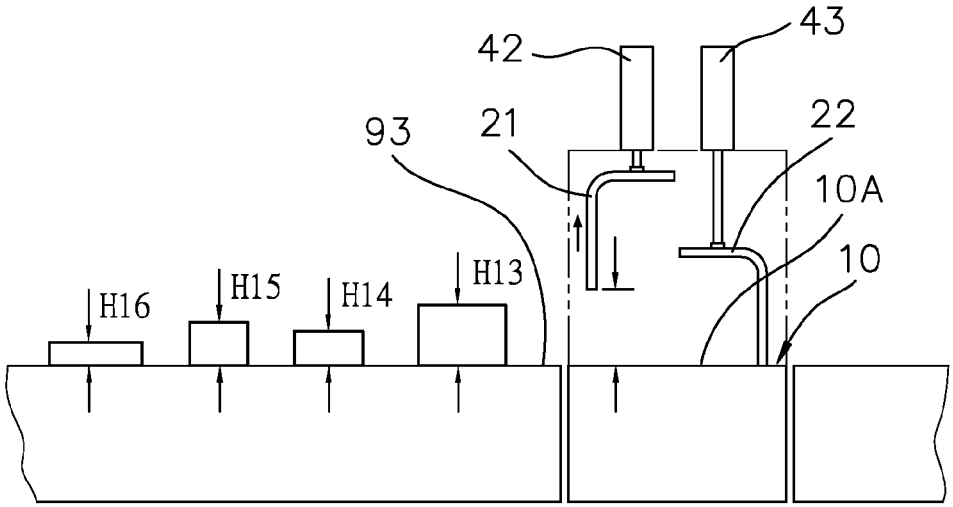
FIG. 11 is a view showing several objects with different heights in this invention.

Based on the above description, the moving distances of the access guiding portion 21 and the exit guiding portion 22 can be varied depending on the object's actual height (just slightly higher than the object 70 is enough). It can avoid unnecessary movement. That also means it saves time (to increasing the working efficiency) and saves energy (lowering the cost). As illustrated in FIG. 11, there are four objects with a third predetermined height H13, a fourth predetermined height H14, a fifth predetermined height H15, and a sixth predetermined height H16 respectively. When the object with the third predetermined height 13 moves into the position on the working surface 10A, the required moving distances of the access guiding portion 21 and the exit guiding portion 22 are relatively longer. When the object with the sixth predetermined height 16 moves into the position on the working surface 10A, the required moving distances of the access guiding portion 21 and the exit guiding portion 22 become relatively shorter. Also, the required moving time is less.

Figure 12:
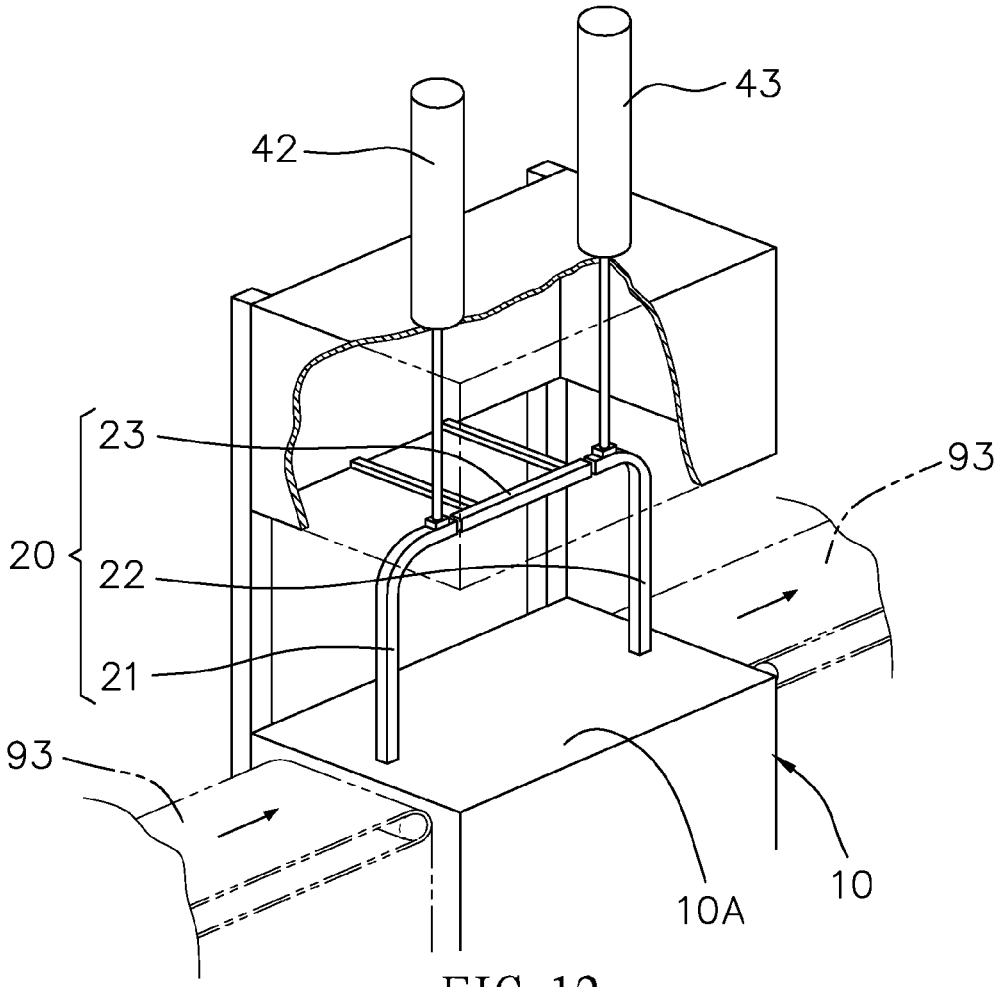
FIG. 12 is a perspective view of the second preferred embodiment of the present invention.
Figure 13A:
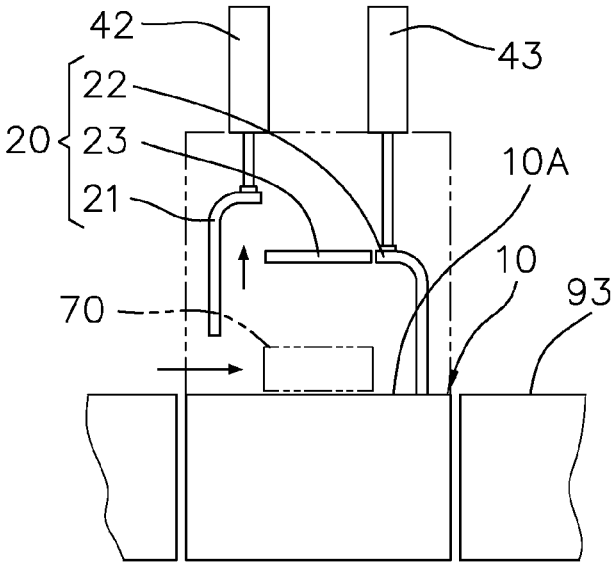
FIG. 13A shows the strapping process one of the first preferred embodiment of present invention.
Figure 13B:
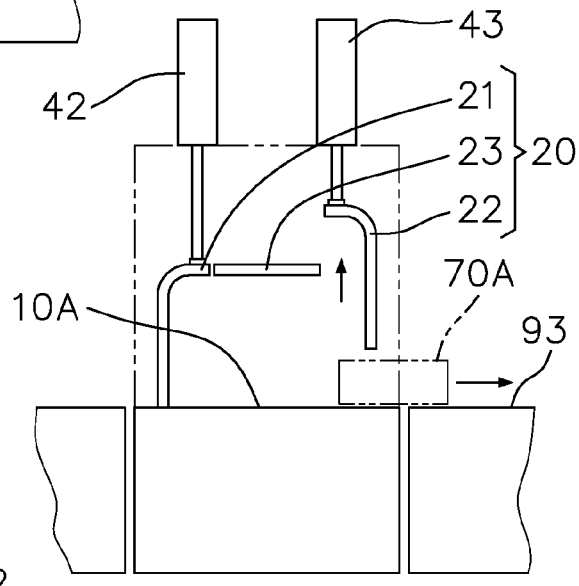
FIG. 13B shows the strapping process two of the first preferred embodiment of present invention.

As shown in FIG. 12, it is the second preferred embodiment of the present invention. The strap chute 20 further comprises a horizontal portion 23 which is fixed on the machine body 10. This horizontal portion 23 is disposed between the access guiding portion 21 and the exit guiding portion 22. Referring to FIGS. 13A and 13B, when the object 70 moves, the required moving distances of the access guiding portion 21 and the exit guiding portion 22 are just slightly higher than the object 70.

Figure 14:
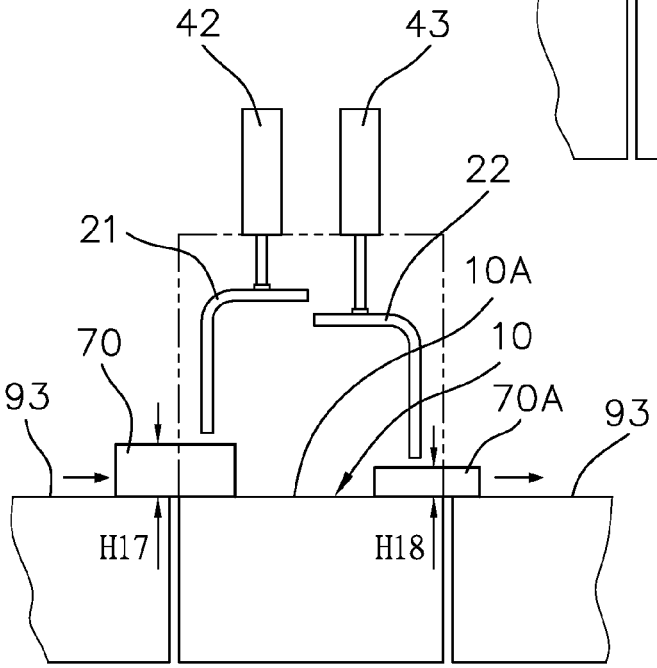
FIG. 14 is a view showing two objects are moved simultaneously in this invention.

In addition, the access guiding portion 21 and the exit guiding portion 22 can be controlled to have different moving distances simultaneously. So, the object 70 with a height can be moved in (entering the working surface 10A) and the strapped object 70A with another different height can be moved out (leaving the working surface 10A) can be moved at the same time. It can save more time for the strapping work. As illustrated in FIG. 14, the access guiding portion 21 and the exit guiding portion 22 move to reach different heights, so that the object 70 (before strapping) with a seventh predetermined height H17 can be move in the working surface 10A and the strapped object 70A (after strapping) with an eight different height H18 can be moved out the working surface 10A simultaneously.

The advantages and functions of this invention can be summarized as follows.

[1] The vertical moving distances of the access guiding portion and the exit guiding portion can be adjusted independently. The strap chute of the traditional strapping machine cannot be varied by the height of the object 70. No matter the height of the object 70 is high of low, the traditional one cannot adjust. It is impossible to adjust independently. However, about this invention, vertical moving distances of the access guiding portion 21 and the exit guiding portion 22 of the strap chute 20 of the present invention can be adjusted to the minimum ones. Not only it can save time (increasing efficiency), but also it can save energy (lowering the cost).

[2] It can save the waiting time. About this invention, after the exit guiding portion 22 moves down to its original position, the new object 70 can be moved in to the working surface 10A. Then, the access guiding portion 21 can be moved down to start a strapping work. Therefore, the access guiding portion 21 and the exit guiding portion 22 can be moved independently (not simultaneously). Under this condition, it can save more working time.

While this invention has been particularly shown and described with references to the preferred embodiments thereof, it will be understood by those skilled in the art that various changes or modifications can be made therein without departing from the scope of the invention by the appended claims.

What is claimed is:

1. A strapping machine comprising:

a machine body having a working surface, a first hole, and a second hole;

a strap chute including an access guiding portion and an exit guiding portion;

said access guiding portion has an access hole which is corresponding to said first hole; said exit guiding portion has an exit hole which is corresponding to said second hole;

a strap supplying device for supplying a strap and for performing a strapping work; said strap being supplied into said strap chute via said first hole and said access hole and then being guided out via said exit hole and said second hole, said strap being back to said strap supplying device for performing a strapping movement; and a controlling device having a controller, a first driving portion, and a second driving portion; said first driving portion being provided for moving said access guiding portion vertically, said second driving portion being provided for moving said exit guiding portion vertically; a vertically moving distance of said access guiding portion and another moving distance of said exit guiding portion being adjustable independently; and an object height detector for detecting a height of an object, so that said controller can control said vertical moving distances of the access guiding portion and of the exit guiding portion to be just slightly higher than said object.

2. The strapping machine as claimed in claim 1, wherein said strap chute further comprises a horizontal portion which is fixed on said machine body, and said horizontal portion is disposed between the access guiding portion and the exit guiding portion.

* * * * *